US012709908B2

(12) United States Patent
Hercus

(10) Patent No.: US 12,709,908 B2
(45) Date of Patent: Aug. 18, 2026

(54) JIG FOR FORMING STRUCTURAL BUILDING MEMBER

(71) Applicant: Australian Engineered Solutions Pty Ltd, Cranbourne (AU)

(72) Inventor: Darren Hercus, Cranbourne (AU)

(73) Assignee: AUSTRALIAN ENGINEERED SOLUTIONS PTY LTD, Cranbourne (AU)

( * ) Notice: Subject to any disclaimer, the term of this patent is extended or adjusted under 35 U.S.C. 154(b) by 362 days.

(21) Appl. No.: 18/244,418

(22) Filed: Sep. 11, 2023

(65) Prior Publication Data

US 2024/0392591 A1 Nov. 28, 2024

(30) Foreign Application Priority Data

May 26, 2023 (AU) ..... 2023901661

(51) Int. Cl.
*E04G 21/18* (2006.01)

(52) U.S. Cl.
CPC ..... *E04G 21/1891* (2013.01)

(58) Field of Classification Search
CPC . E04G 21/1891; B27M 3/004; B27M 3/0053; B25B 5/006; B27F 7/02; B27F 7/006; E04C 3/14; E04C 3/12; E04C 3/02; E04B 1/26; F16B 5/00; F16B 15/00; F16B 5/06; F16B 9/00
See application file for complete search history.

(56) References Cited

U.S. PATENT DOCUMENTS

| | | | | | |
|---|---|---|---|---|---|
| 3,629,931 | A * | 12/1971 | Stanley | B27F 7/02 | 227/111 |
| 3,751,794 | A * | 8/1973 | Kay | E04C 2/34 | 29/432 |
| 4,039,111 | A * | 8/1977 | Rogers | B27F 7/02 | 227/101 |
| 4,998,336 | A * | 3/1991 | Papsdorf | B27F 7/155 | 269/910 |
| 6,499,206 | B1 * | 12/2002 | Eure | B27M 3/0073 | 29/430 |
| 2007/0006450 | A1 * | 1/2007 | Jaen | B65D 19/0075 | 29/772 |
| 2010/0057242 | A1 * | 3/2010 | Williams | B27F 7/006 | 700/114 |
| 2017/0058525 | A1 * | 3/2017 | Hercus | E04C 3/16 | |
| 2018/0215067 | A1 * | 8/2018 | Wagner | B27F 7/003 | |
| 2018/0326612 | A1 * | 11/2018 | Storti | B27F 7/02 | |
| 2019/0276304 | A1 * | 9/2019 | Kane | B23P 19/008 | |
| 2021/0316472 | A1 * | 10/2021 | Svensson | B27M 1/08 | |
| 2024/0392591 | A1 * | 11/2024 | Hercus | E04G 21/1891 | |

FOREIGN PATENT DOCUMENTS

| | | | |
|---|---|---|---|
| AU | 2019200815 | A1 * | 2/2019 |
| AU | 2019203601 | A1 * | 6/2019 |
| AU | 2021200695 | | 3/2021 |
| AU | 2021201635 | | 4/2021 |

* cited by examiner

*Primary Examiner* — Peter J Macchiarolo
*Assistant Examiner* — Anna Josephine Saunders
(74) *Attorney, Agent, or Firm* — Millen, White, Zelano & Branigan, P.C.; Christopher W. Brody

(57) ABSTRACT

A jig 1 for wooden beam 20 construction, the jig 1 adapted to hold in position an upper beam 21 above a lower beam 22, in or overlapping its vertical footprint 22*a*, the jig 1 including a fastener dispenser 30 mounted on a translocatable carriage 40, the fastener dispenser 30 adapted to mechanically attach the upper beam 21 and the lower beam 22.

9 Claims, 4 Drawing Sheets

JIG FOR FORMING STRUCTURAL BUILDING MEMBER

FIELD OF INVENTION

This invention relates to a jig for forming a structural building member. More particularly, this invention relates to a semi-automated jig for structural building member construction.

BACKGROUND ART

The following references to and descriptions of prior proposals or products are not intended to be, and are not to be construed as, statements or admissions of common general knowledge in the art. In particular, the following prior art discussion should not be assumed to relate to what is commonly or well known by the person skilled in the art, but to assist in the inventive process undertaken by the inventor(s) and in the understanding of the invention.

Conventional truss jigs are generally comprised of a horizontal flat bed. Jigs for wooden I-beam construction have been described in which a jig is positioned horizontally such that an upper and lower portion of the I-beam are vertically at the same height. Typically, an operator then fastens the upper and lower portions to a mid-portion with fasteners, and glue is applied as a secondary reinforcement of the join, although the Applicant's practice emphasises the reliance on glue alone to effect the block to chord join, as described in Australian Patent Nos. 2021200695 and 2021201635, the entire contents of each of which are incorporated herein by reference. However, the traditional jig typically requires at least 2 operators on either side of the jig and the operators may be required to lean over the jig to apply glue and to check that each portion is secured accurately. Furthermore, clamps are the primary force holding the beam components together while the glue or fasteners are used to fix the beam components together, while the glue (adhesive) cures.

An object of the present invention is to ameliorate one or more of the aforementioned disadvantages of the prior art or to at least provide a useful alternative thereto.

STATEMENT OF INVENTION

The invention according to one or more aspects is described herebelow and further defined in the independent claims. Some optional and/or preferred features of the invention are described herebelow and further defined in the dependent claims.

Accordingly, in one aspect of the invention there is provided:

A jig for forming a structural building member, the jig including:

(a) a main support structure oriented in an upright orientation to be capable of supporting the unassembled structural building member components, the components including a beam for forming the structural building member in upright orientation aligned to an upright plane; and (b) a translocatable apparatus movably mounted to the main support structure and having mounted thereto a fastener dispenser.

In another aspect of the same invention, the jig is operable to assemble a wooden truss, wherein the jig is adapted to hold in position the beam, being in the form of an upper beam, above a lower beam, one or other of the upper or lower beam being within or overlapping the other beam's vertical footprint, or an upright footprint of the other beam, the jig including the fastener dispenser mounted on the translocatable apparatus, the fastener dispenser adapted to mechanically attach the upper beam directly or indirectly and the lower beam.

Preferably, the beam is an elongate length of timber (UK) or lumber (US). The structural building member may include only one beam. Preferably, the structural building member includes a multiple beams. The beams may be parallel or one may be raked relative to the other. The beams may be spaced from each other. The beams may be spaced from each other along their respective entire lengths. The beams may be coterminal and coextensive, i.e. of the same length.

Preferably, the structural building member is a wooden truss. The pair of beams may be a pair of chords, including an upper chord and a lower chord. Preferably the structural building member comprises a web. The web may comprise web-forming supports. The web-forming supports may be blocks that are adapted to be combined to form webbing. The web-forming supports may be mid-supports adapted to form webbing between the upper and lower chords.

The jig for the wooden beam construction preferably includes the main support structure and the translocatable apparatus. The translocatable apparatus is preferably mounted to move parallel to the upright plane. The translocatable apparatus may be adapted to move laterally. The translocatable apparatus may be adapted to travel reciprocatingly. The translocatable apparatus may be adapted to move laterally and reciprocatingly. The movement of the translocatable apparatus may be a sliding movement. The translocatable apparatus may be in the form of a dog or carriage. The translocatable apparatus may be in the form of a sliding carriage. The main support structure is preferably adapted to be stationary. The translocatable apparatus is preferably adapted to move horizontally along the main support structure. The translocatable apparatus is preferably adapted to transpose lengthwise along the main support structure. The main support structure preferably includes a wooden beam holder. The wooden beam holder is adapted to hold the wooden beam at the upright orientation, being vertical, or at a slight angle off vertical, for example between 0 and 15 degrees relative to a vertical plane.

The fastener dispenser may be operative to attach the upper beam to the lower beam with mid supports that are interposed between the upper beam and lower beam.

Preferably, the jig includes an adhesive applicator or adhesive applicating guide. The adhesive applicator may be mounted on the translocatable apparatus. The adhesive applicator may travel with the translocatable apparatus in a first pass along the length of the beam to apply adhesive at predetermined locations along the length of the beam. The predetermined locations may correspond to where the mid-supports will be placed in abutment to the beam. The jig may include a mid-supports location guide that guides an operator to place a block on and/or under the beam, whereby to sandwich the adhesive between the chord and the block. Where the web is to be interposed between a pair of upper and lower beams, each block may be placed in abutment with the beams. The adhesive applicating guide may provide a visual marker along the length of the beam for an operator to place the adhesive on and/or under the beam.

In yet another aspect of the invention there is provided:

A method for construction of the wooden beam including applying adhesive to the upper and lower wooden beams and clamping them together with the mid supports interposed between the upper and lower beams in the jig, locating the translocatable apparatus at various points along the wooden beam in line with the mid supports and inserting fasteners through the upper and lower beams into the mid supports with the fastener dispenser to mechanically secure the wooden beam together, optionally removing the wooden beam from the jig while the adhesive is still uncured.

Operation of the translocatable carriage and fastener dispenser may be partially or fully automated.

The upper beam may be adapted to be attached indirectly to the lower beam with an arrangement of the mid supports (which, for example, may be blocks) bridging the upper and lower beams. Preferably, this arrangement forms a truss structure with an upper beam (chord), lower beam (chord). The arrangement of the truss structure includes generally traversely, and more preferably transversely, aligned blocks spanning between the beams (chords) to form the web. The web may be between the beams and may be positioned to space the beams from each other along part, or preferably the whole, of the length of the beams.

The wooden beam may include a raked upper beam (chord) relative to the lower or other beam (chord). In this arrangement, the upper beam (chord) may be the raked beam. The upper beam may be indirectly secured to the lower beam (chord) at an angle in the range of 3°-15° off a direction parallel to the lower beam.

The fastener dispenser may include a pair of dispenser units. The fastener dispenser may be orientated with the fasteners adapted to be ejected at a non-perpendicular angle to a longitudinal axis of the upper beam and/or the lower beam. The pair of dispenser units may be adapted to deliver the fasteners to the upper and/or lower beam in a direction at an angle transverse relative to the longitudinal axis of the respective upper beam or the lower beam.

The translocatable carriage may be adapted to translocate along the jig. The translocation of the carriage may be in the form of a reciprocal action. The translocation of the carriage may be along a linear pathway. The translocatable carriage is preferably mounted on a rail device. The rail device may extend parallel to the longitudinal axis.

The rail device may include an upper rail and a lower rail. The translocatable carriage may be mounted on one or both of the upper rail and the lower rail. Preferably, the translocatable carriage is mounted on the upper rail and the lower rail. Hereinafter, the rail device will be referred to as "the rail".

The translocatable apparatus may further include a roller adapted to press onto the upper and/or lower beams adjacent the fastener dispenser. The roller may include a bearing or wheel adapted to roll along the upper and/or lower beams, preferably the upper beam.

The roller may advantageously maintain an accurate (+−5 mm) vertical position of an upper surface of the upper beam adjacent the fastener dispenser. The translocatable apparatus may include a contour follower that is adapted to adjust to the vertical location of the upper beam at any location along the length of the upper beam. The contour follower may include a roller or slide that is adapted to follow the contour of an upper surface of the upper beam.

The slide may have a curved or cammed lower surface whereby to slidably engage with low friction with a top surface of the upper beam.

The contour follower preferably comprises a roller adapted to follow the contour of the upper surface of the beam as it rolls there-along and thereon. The translocatable apparatus preferably is mounted to the main support via a height following means, such as an upright rail or an arm mounted on a pivot. The pivot arm may preferably be biased toward the upper beam by spring means or may simply be biased by gravity. The translocatable apparatus may therefore be moveable both in the direction generally parallel to one or both of the beams, i.e. generally horizontally, and also moveable up and down or vertically, by virtue of the contour follower. The contour follower may be located adjacent to the fastener dispenser. The contour follower may be located between two upper fastener dispenser units.

The upright or near-vertical orientation of the main support structure of the jig, being a first jig, may allow for compact positioning or attachment to the first jig of a like second jig. The second jig may be in the form of a close mirror image of the first jig. The second jig may abut the first jig on a rear side of the first jig. Therefore, the upright or near-vertical orientation of the first jig may allow manufacturing of multiple wooden beams (for example, truss structures) on the pair of mirrored first and second jigs.

Fastener Dispenser

The fastener dispenser is preferably a mechanical fastener dispenser. The fastener dispenser may be mounted on the translocatable apparatus. The translocatable apparatus may slide or roll on the rail. The rail may be configured to extend along an axis parallel, or near-parallel in the range of 3°-15° off parallel, to the longitudinal axis of the upper and/or the lower chords. The rail may include the upper and the lower rail.

The fastener dispenser may be adapted to mechanically attach a plurality of mid supports to the beam. The mid-supports may be mid-beam members. The mid supports are preferably interposable between the upper beam and the lower beam to form a web therebetween. The mid supports are preferably in the form of wooden blocks or boards. The blocks may be offcuts or bespoke blocks cut to size for the required spacing between the upper and lower beams at the point along the wooden beam for that mid support in the web. The boards may be panels of timber or lumber suitable for forming end dockable portions of the wooden beam. The boards may be dockable to enable the wooden beam to be cut to a required length on site (in situ).

Fastener Dispenser Orientation

The fastener dispenser may be adapted to insert fasteners into a top side of the upper beam and/or through a bottom side of the lower beam. The fastener dispenser may be adapted to insert fasteners at a non-perpendicular angle, relative to a longitudinal axis of the upper and lower beams, downwards into the upper beam and upwards into the lower beam. Alternatively, the dispenser may be vertically positioned to insert the fasteners firstly through the mid supports near an end of the or each mid-support up into an underside of the upper beam and/or an upper surface of the lower beam. The non-perpendicular angle may advantageously resist separation of the upper and lower beams away from each other and/or the mid supports.

The fastener dispenser may include 4 or sets of 4 dispenser units. The fastener dispenser may be adapted to dispense fasteners at between 30 and 70 degrees relative to the longitudinal axis of the upper and lower beams. The fastener dispenser may include a single upper dispenser unit adapted to deliver fasteners into the upper beam. The fastener dispenser may include a single lower dispenser unit adapted to deliver fasteners into the lower beam. The fastener dispenser preferably includes a set of angled dispenser units adapted to deliver fasteners to the upper beam. The fastener dispenser may include a similar but vertically opposed set of dispenser units adapted to deliver fasteners to the lower beam. The respective upper and lower set of dispenser units may mirror each other. The upper set of dispenser units may comprise an upper pair of dispenser units. The lower set of dispenser units may comprise a lower pair of dispenser units. The fastener dispenser preferably includes the mirrored pairs of upper and lower dispenser units adapted to be positioned respectively above the upper beam and below the lower beam. Another advantage of the vertical orientation of the jig is that the upper fastener dispenser may be supported above the top surface of the upper beam by the contour follower, such as may be in the form of a board runner, slide or roller. Advantageously, this allows the fastener dispenser to travel along the beam on an angle allowing for easier fabrication of the raked trusses.

The fastener dispenser mount to the translocatable carriage may include height and laterally adjustable brackets, preferably pivotable to enable the angle of each dispenser unit to be adjusted to achieve an optimal position.

Jig

The jig is preferably adapted for the formation of the wooden beam in which the wooden beam includes the mid support. The mid support may be in the form of a beam, plate or board. Preferably, the mid support is in the form of a web. The web is preferably a partially open structure with gaps between web members for weight reduction, material conservation and services access. The jig includes a main support structure. The support structure is preferably stationary. The translocatable apparatus may be in the form of a dog. The translocatable apparatus may be advantageously a sliding apparatus. The translocatable apparatus may be in the form of a translocatable carriage. The carriage may be operable to transpose lengthwise along the main support structure.

The wooden beam may have a general plane in which it lies when assembled on the jig. The main support structure may include a wooden beam holder which is adapted to hold the wooden beam at a slight angle off vertical, whereby the general plane is between 0 and 15 degrees from vertical.

Wooden Beam

The term "wooden" is generically used herein to take account of the American usage of 'lumber" and the British usage of "timber" to mean sawn or processed wood-therefore, "wooden" herein means sawn or processed wood products.

The wooden beam is preferably an I-beam. The wooden beam may include an I-beam, T-beam, L-beam and other beams comprising multiple wooden or other components fastened together. The wooden beam may include metal components such as metals plates and metal supports. Preferably, the wooden beam includes only wooden support structures.

The upper and lower beams may be elongate beams. The upper and lower beams may be elongate wooden planks. The upper and lower beams may be identical. The upper and lower beams may have the same width. The upper and lower beams may be elongate beams with a 2 inch width and 4 inch thickness.

The jig may include the translocatable carriage. The translocatable carriage may include the fastener dispenser. The translocatable carriage may be adapted to slide, roll or move along a wooden beam holder. Preferably, the translocatable apparatus is adapted to roll along the rails of the rail device.

Advantageously, the vertical orientation of the jig may enable far less wastage of adhesive through the adhesive being applied to near-upward or downward facing surfaces. The adhesive may be applied to only near-upward or downward facing surfaces (being between zero and 15 degrees from vertically facing).

Wooden Beam Holder

The wooden beam holder may be adapted to receive the upper, lower beams and mid supports. The wooden beam holder may be adapted to secure and compress the upper, lower beams and mid supports together. The wooden beam holder may be adapted to clamp the upper, lower and mid supports together. The wooden beam holder may be adapted to hold the wooden beam in passive compression due to gravity such that the upper beam pushes onto the mid supports and onto the lower beam.

Translocatable Carriage

The translocatable carriage may be adapted to translocate the fastener dispenser such that the fastener dispenser moves along a longitudinal axis of the wooden beam. The translocatable carriage may be adapted to translocate across the wooden beam and insert fasteners at multiple locations across the wooden beam. It will be appreciated that any of the features described herein can be used in any combination, and that the invention as described in respect of the second aspect may have the specific features referred to above in respect of the invention as described in respect of the first aspect.

Mirrored Jigs

Another embodiment may include two identical mirrored jigs abutting each other. A rear side of a first jig may abut the second jig. Advantageously, this arrangement reduces support necessary for a single jig and provides space saving. The two identical jigs may be mirrored. The two identical jigs may receive power and air pressure from the upper region of the main support structure of each jig.

The mirrored jigs may be connected to synchronize automation and allow a single operator to use both jigs.

BRIEF DESCRIPTION OF THE DRAWINGS

The invention may be better understood from the following non-limiting description of preferred embodiments, in which.

DETAILED DESCRIPTION OF THE DRAWINGS

Figure 1:
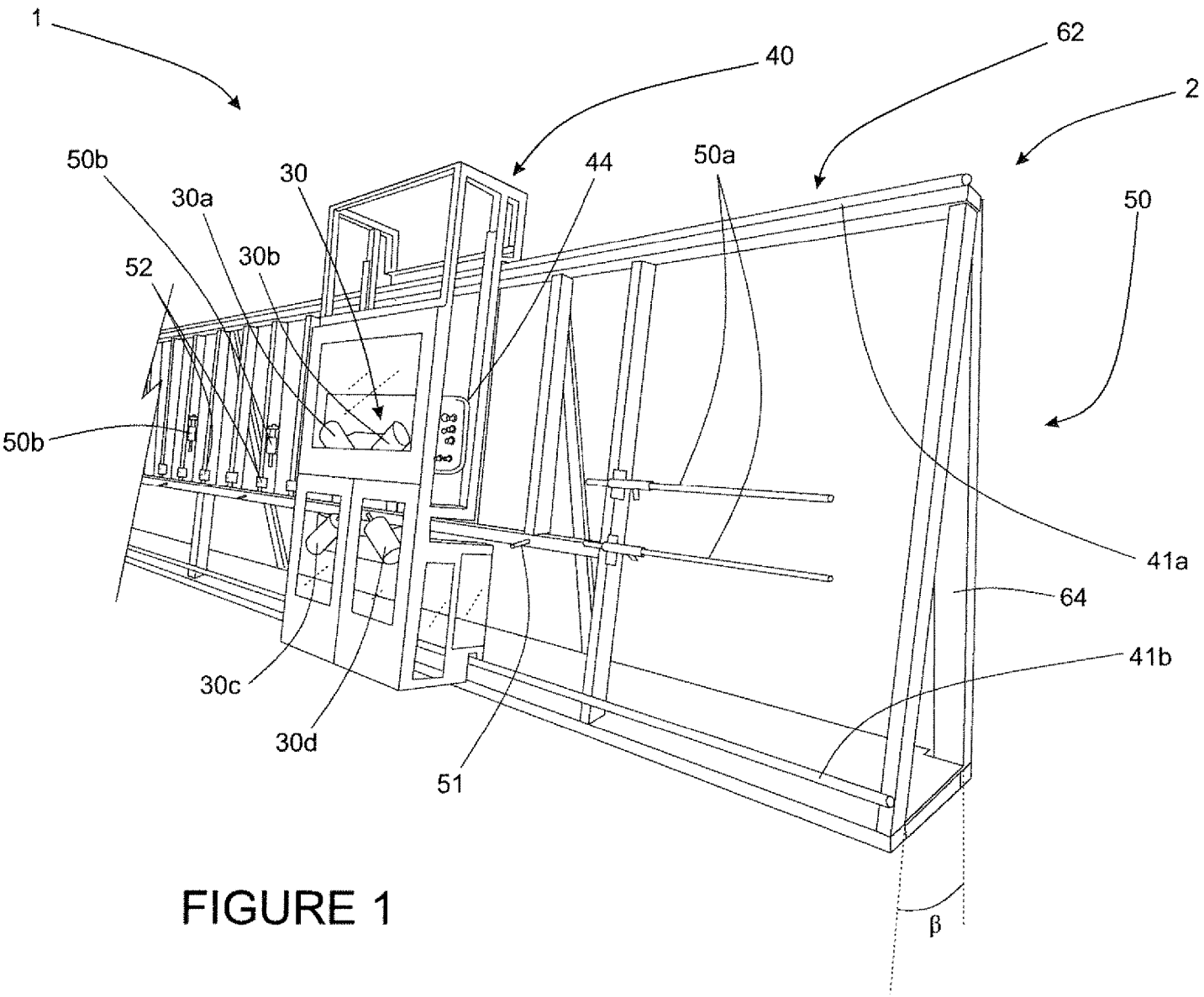
FIG. 1 is a perspective view of a jig for wooden beam construction with a schematic depiction of the fastener dispenser location.
Figure 2:
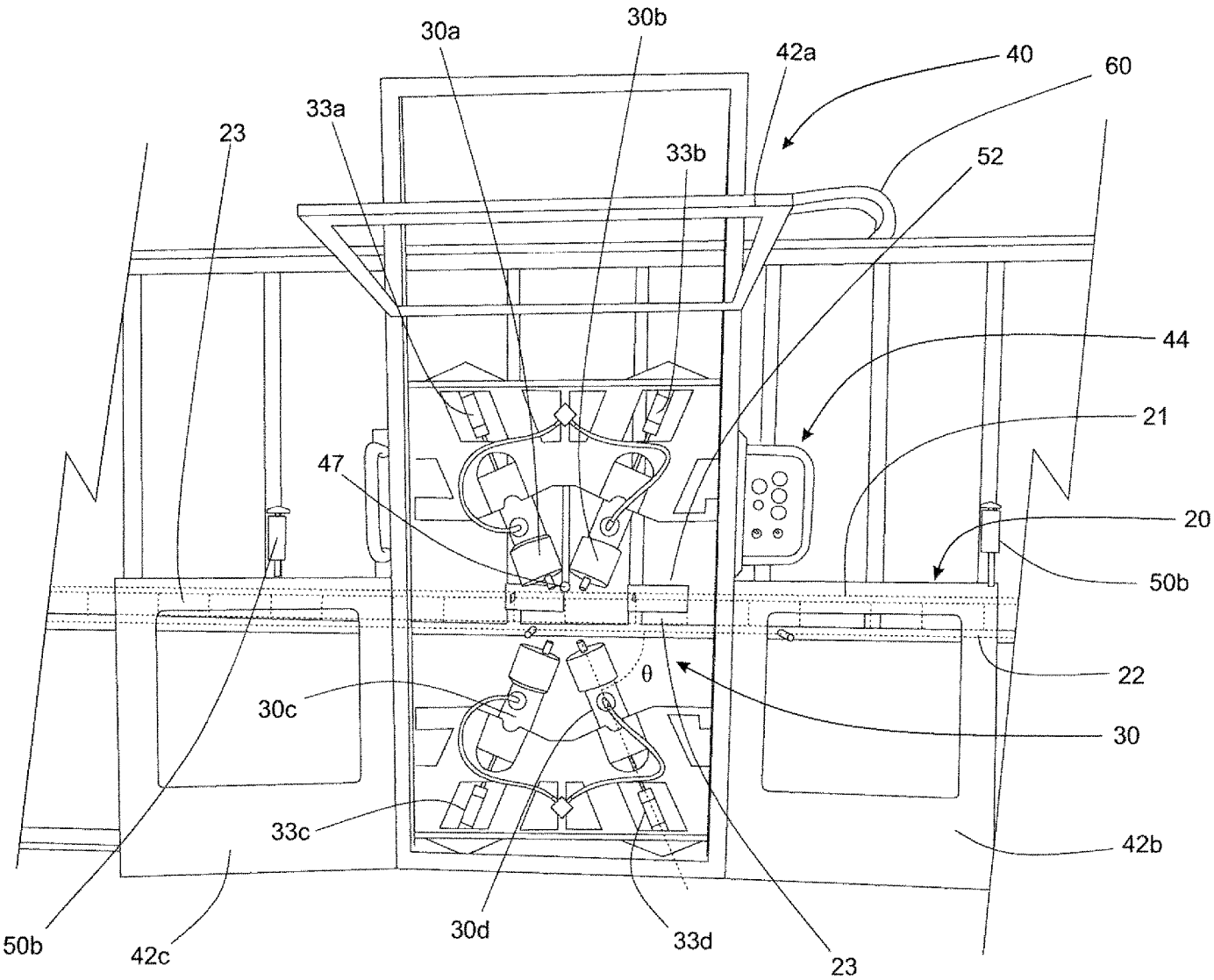
FIG. 2 is a perspective front view of the jig for wooden beam construction.
Figure 3:
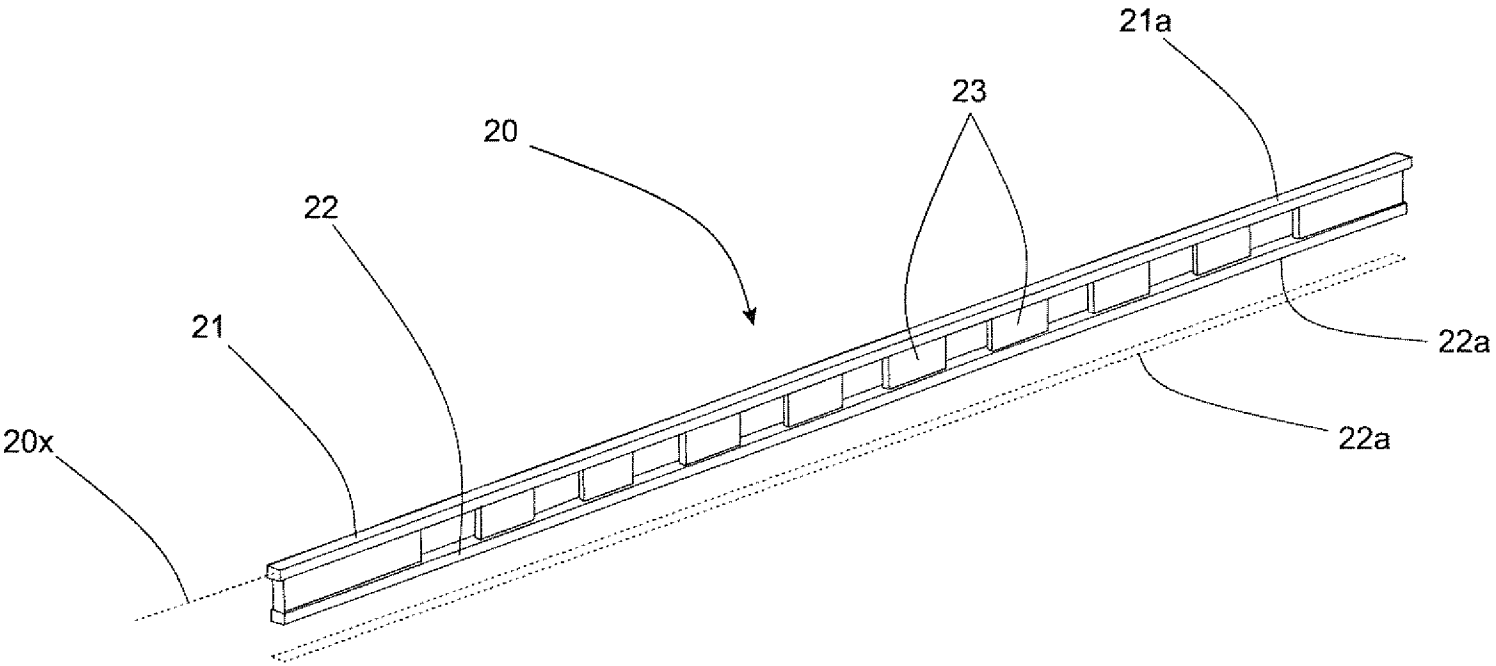
FIG. 3 is a front view of an assembled wooden beam.

Preferred features of the present invention will now be described with particular reference to the accompanying drawings. However, it is to be understood that the features illustrated in and described with reference to the drawings are not to be construed as limiting on the scope of the invention. In describing the various embodiments of the invention, like features will be referred to using like references, with references for features of each embodiment generally preceded by 1, 2, 3, or followed by a Roman numeric sequence, such as i, ii, iii, etc. or an alphabetical sequence such as a, b, c, relative to the corresponding feature of the first embodiment. For example, a feature 10 of the first embodiment may represented as 110, 210, 310, (or n10), or 10*a*, 10*b*, 10*c*, (or 10*x*) or 10*i*, 10*ii*, 10*iii*, (or 10*r*) etc. in second, third and fourth embodiments, respectively.

The drawings show a jig 1 for wooden beam 20 construction, the jig 1 adapted to hold in position an upper beam 21 (upper chord) above a lower beam 22 (lower chord), in or overlapping its vertical footprint 22*a*, the jig 1 including a fastener dispenser 30 mounted on a translocatable carriage 40, the fastener dispenser 30 adapted to mechanically attach the upper beam 21 and the lower beam 22.

The jig 1 may be further described as being adapted to hold in position an upper beam 21 above a lower beam 22, in or at least partially overlapping its vertical footprint 22*a*, the jig 1 including a fastener dispenser 30 mounted on a translocatable carriage 40, the fastener dispenser 30 adapted to mechanically attach the upper beam 21 to the lower beam 22 with mid supports 23 that are interposed between the upper beam 21 and lower beam 22.

A method for construction of the wooden beam 20 includes applying adhesive to the upper and lower beams 21, 22 and clamping them together with the mid supports 23 interposed between the upper and lower beams 21, 22 in the jig 1, locating the translocatable carriage 40 at various points along the wooden beam 20 in line with the mid supports 23 and inserting fasteners through the upper and lower beams 21, 22 into the mid supports 23 with the fastener dispenser 30 to mechanically secure the wooden beam 20 together, optionally removing the wooden beam 20 from the jig 1 while the adhesive is still uncured.

Operation of the translocatable carriage 40 and fastener dispenser 30 is partially automated, for example using PLC controls.

The upper beam 21 is adapted to be attached indirectly to the lower beam 22 with an arrangement of the mid supports 23 bridging the upper and lower beams 21, 22. The mid supports 23 in the form of wooden blocks or boards.

The fastener dispenser includes a pair of dispenser units orientated with the fasteners adapted to be ejected at a non-perpendicular angle to a longitudinal axis of the upper and lower beams.

Fastener Dispenser

The fastener dispenser 30 is mounted on the translocatable carriage 40. The translocatable carriage 40 is adapted to slide or roll on an upper and lower rail 41*a,b*. The rails 41*a,b* may be configured to extend along an axis parallel to the longitudinal axis 20*x* of the upper and/or the lower beam 21, 22.

The fastener dispenser 30 are adapted to mechanically attach a plurality of the mid supports 23 or mid beam members that are interposable between the upper beam 21 and the lower beam 22 to form a web therebetween.

The translocatable carriage 40 may further include a roller 47 adapted to press onto and roll across the upper and/or lower beam 21, 22 adjacent the fastener dispenser. The roller 47 may include a bearing or wheel adapted to roll along the upper and/or lower beam 21, 22, preferably the upper beam 21.

The roller 47 may advantageously maintain an accurate (+−5 mm) vertical position of an upper surface 21*a* of the upper beam 21 adjacent the fastener dispenser. The translocatable carriage may include just one roller adapted to be located adjacent to and between two upper dispenser units 30*a,b*.

Fastener Dispenser Orientation

The fastener dispenser 30 is adapted to insert fasteners into a top side 21*a* of the upper beam and through a bottom side 22*a* of the lower beam 22. The fastener dispenser 30 is adapted to insert fasteners at a non-perpendicular angle θ, relative to a longitudinal axis 20*x* of the upper 21 and lower beams 22, downwards into the upper beam 21 and upwards into the lower beam 22. The non-perpendicular angle θ is advantageously resist separation of the upper and lower beams 21, 22 away from each other.

The fastener dispenser 30 may include 4 or sets of 4 dispenser units 30*a,b,c,d*. The fastener dispenser 30 is adapted to dispense fasteners at 65+−15 degrees relative to the longitudinal axis 20*x* of the upper and lower beams 21, 22. The fastener dispenser 30 includes a pair of angled dispenser units 30*a,b* adapted to be positioned above the upper beam 21 and a pair of mirrored dispenser units 30*c,d* adapted to be positioned below the lower beam 22.

The fastener dispenser 30 includes nail guns 30*a,b,c,d* or screw guns. The fastener dispenser 30 includes air actuated pistons 33*a,b,c,d* that are adapted to thrust the fastener dispenser 30 into the upper and lower beams 21, 22 to insert the fasteners into the upper and lower beams 21, 22. The air actuated pistons 33*a,b,c,d* are partially automated such that the fastener dispenser is adapted to actuate all of the air actuated pistons 33*a,b,c,d* and/or fastener dispenser 30 at the same time.

The jig land fastener dispenser 30 can therefore be operated by a single operator. The translocatable carriage further includes a control 44 panel adapted to control actuation of the fastener dispenser 30 and air actuated pistons 33*a,b,c,d*. The translocatable carriage 40 also includes shields 42*a,b,c* adapted to protect the operator.

Jig

The jig 1 is adapted for the formation of the wooden beam 20 in which the wooden beam 20 has the mid support 23. The mid supports 23 may be in the form of a chord and a web 23. The jig 1 may include a main support structure 2. The support structure 2 is preferably stationary. The translocatable carriage 40 may be in the form of a dog. The translocatable carriage 40 is advantageously a sliding apparatus. The translocatable carriage (carriage) is operable to transpose lengthwise relative to the main support structure 2.

The wooden beam 20 has general plane in which it lies when assembled on the jig 1. The main support structure 2 includes a wooden beam holder 50 which is adapted to hold the wooden beam 20 at a slight angle off vertical, whereby the general plane is between 0 and 15 degrees from vertical. The wooden beam holder 50 includes pegs 51 adapted to support the lower beam 22 and plate spacers 52 that are adapted to accurately position and support the mid supports 23 while the clamps are being attached to secure the wooden beam 20 together temporarily.

The jig 1 includes the main support structure 2 and the translocatable carriage 40. The support structure 2 is adapted to be stationary and the translocatable carriage 40 is adapted to transpose lengthwise along the main support structure 2, the main support structure 2 including a wooden beam holder 50 which is adapted to hold the wooden beam 20 at a slight angle off vertical; between 0 and 15 degrees from vertical.

The jig 1 is adapted to orientate the wooden beam vertically such that the upper beam 21 is vertically higher than the lower beam 22. Advantageously, this allows an operator to view the beam while it is being assembled opposed to leaning over a horizontal jig to view the components of the wooden beam 20 are in an accurate position. Furthermore, an operator has full access to position the mid supports 23 and upper and lower beams 21, 22.

Wooden Beam

The term "wooden" is generically used herein to take account of the American usage of 'lumber" and the British usage of "timber" to mean sawn or processed wood-therefore, "wooden" herein means sawn or processed wood products.

The wooden beam 20 is an I-beam. The upper and lower beams 21, 22 are elongate beams.

Advantageously, the vertical orientation of the jig may enable far less wastage of adhesive through the adhesive being applied to near-upward facing surfaces. Preferably, the adhesive is applied to only near-upward or downward facing surfaces (being between zero and 15 degrees from vertically facing).

Wooden Beam Holder

The wooden beam holder 50 is adapted to receive the upper, lower beams and mid supports. The wooden beam holder includes clamps 50*a,b* that are adapted to secure and compress the upper, lower beams and mid supports 21, 22, 23 together. The wooden beam holder 50 is adapted to clamp the upper, lower and mid supports together.

Translocatable Carriage

The translocatable carriage 40 is adapted to translocate the fastener dispenser 30 such that the fastener dispenser 30 moves along a longitudinal axis 20*x* of the upper and lower beams 21, 22. The translocatable carriage 40 is adapted to translocate across the wooden beam 20 and insert fasteners at multiple locations across the wooden beam 20. Each location of the multiple locations corresponds to the position of a mid support member, block or board interposed between the upper and lower beams to form the web.

Cabling

The jig includes a snake or trunking cable housing 60 adapted to deliver air and electricity to the carriage 40. The trunking cable housing 60 runs along an upper region 62 of the main support structure 2.

Mirrored Jigs

Figure 4:
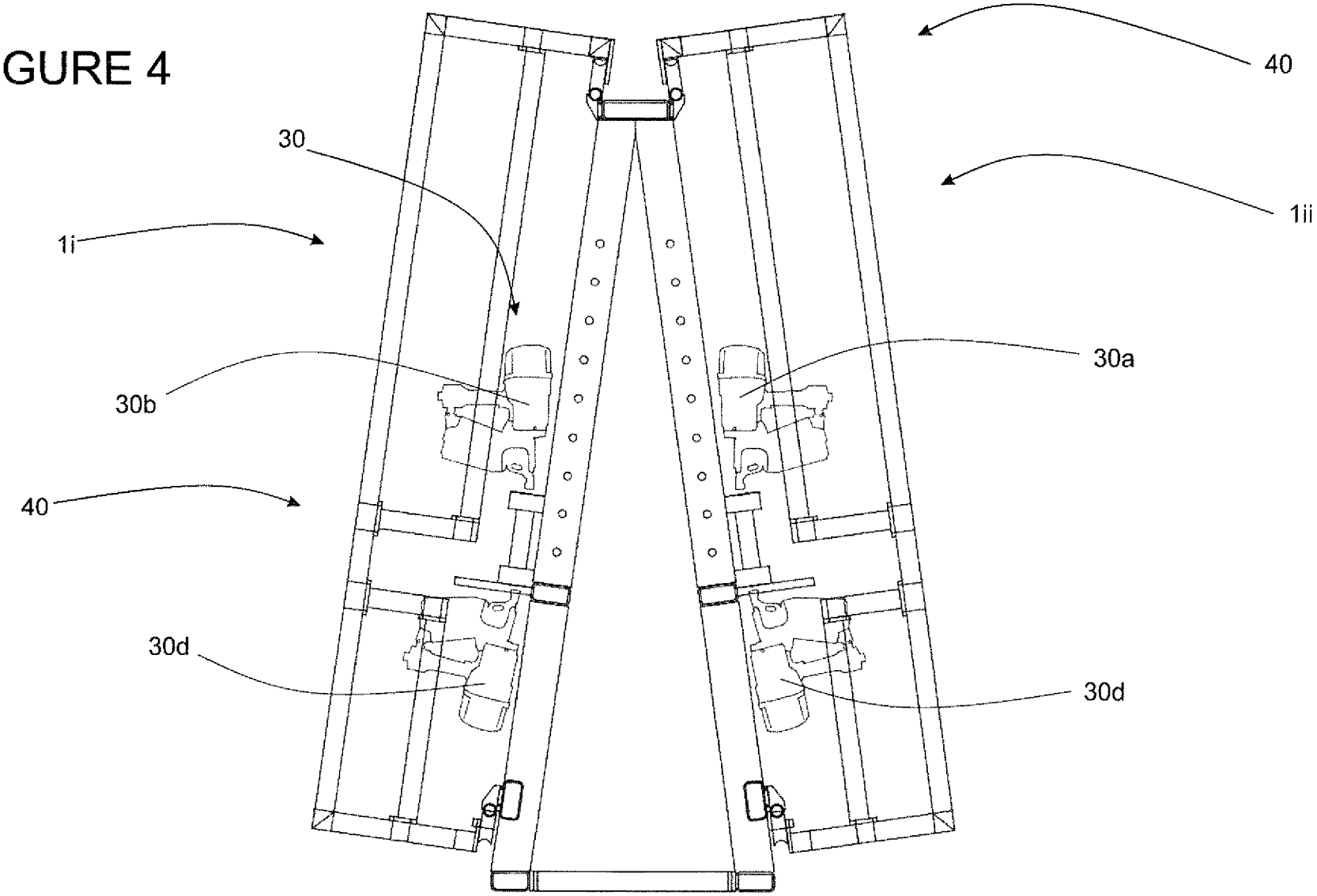
FIG. 4 is a right side cross sectional view of two mirrored jigs abutting each other.

FIG. 4 shows an embodiment including 2 identical jigs 1. A rear side of a first jig 1*i* abuts the second jig 1*ii*. Advantageously, this arrangement reduces support necessary for a single jig and provides space saving. The 2 identical jigs 1*i*, 1*ii* are mirrored. The 2 identical jigs 1*i*, 1*ii* receive power and air pressure from the upper region 62 of the main support structure 2 of each jig. The identical jigs 1 may each be the jig 1 as described with rear supports 64 removed.

Throughout the specification and claims the word "comprise" and its derivatives are intended to have an inclusive rather than exclusive meaning unless the contrary is expressly stated or the context requires otherwise. That is, the word "comprise" and its derivatives will be taken to indicate the inclusion of not only the listed components, steps or features that it directly references, but also other components, steps or features not specifically listed, unless the contrary is expressly stated or the context requires otherwise.

In the present specification the word "beam" refers to an elongate structure such as a truss, chord of a truss, an I-beam, an L-beam, a T-beam or wooden square or rectangular cross sectioned plank such as an elongate 2"×4" wooden plank (commonly known as a "2 by 4").

The word "beam" includes within its scope a "chord" or "plate". A chord or plate refers to a linear and cross-sectionally consistent length of timber adapted to form, or forming, part of a fully assembled truss beam, I-beam, T-beam, L-beam or other composite mainly wooden structure, that comprises multiple components combined to form an operationally single beam structure.

The word "block" refers to a typically short stub of timber, such as timber offcuts, or other material, adapted to form part of a web extending from a chord or plate.

The word "wooden" refers to "lumber" (according to US usage) and timber (according to UK usage).

The word "web" refers to its standard usage in wooden building construction, referring to the multiple traversely or transversely aligned struts or blocks forming a thin flat or partially open part extending between thicker, more solid, elongate structures.

The word "truss" describes a multiple component structure comprising at east one chord and a web that together form an operationally single beam.

An "upright footprint" of the upper or lower beam is a projection viewed from above, along a line parallel to the upright plane, wherein the line is also parallel to a vertical plane extending perpendicular to the upright plane.

In the present specification, terms such as "apparatus", "means", "device" and "member" may refer to singular or plural items and are terms intended to refer to a set of properties, functions or characteristics performed by one or more items or components having one or more parts. It is envisaged that where an "apparatus", "means", "device" or "member" or similar term is described as being a unitary object, then a functionally equivalent object having multiple components is considered to fall within the scope of the term, and similarly, where an "apparatus", "assembly", "means", "device" or "member" is described as having multiple components, a functionally equivalent but unitary object is also considered to fall within the scope of the term, unless the contrary is expressly stated or the context requires otherwise.

In the present specification, the phrase "and/or" refers to severally or any combination of the features. For example, the phrase "feature 1, feature 2 and/or feature 3" includes within its scope any one of the following combinations: Feature 1 or feature 2 or feature 3; feature 1 and feature 2 or feature 3; feature 1 or feature 2 and feature 3; feature 1 and feature 3 or feature 2; feature 1 and feature 2 and feature 3.

The meaning of descriptive, precise or absolute terms such as "flexed", "normal", "parallel", "horizontal", "vertical" or "fully" includes the preceding qualifier "substantially or almost", unless the context or contrary is expressly indicated.

Qualifying relative terms, such as "relatively", "sufficiently", "near", "almost" or "substantially", may be taken to indicate a variation in an absolute value of between 0° and 10° or between 0% and 10%, relative to the absolute value. For example, "near horizontal" may be taken to mean any orientation between 0° and 10° relative to the horizontal.

Where the word "for" is used to qualify a use or application of an object term, the word "for" is only limiting in the sense that the device or component should be "suitable for" that use or application.

In the present specification, the term "integral" means formed of one body in a single process. In particular, the term "integrally formed" means formed of the one body without post-forming attachment of separately formed component parts. That is, "integrally formed" and the similar term "unitarily formed" mean formed in a single forming process and do not include post-forming attachment of component parts by means of fastener or other component fixing substances or methods.

Orientational terms used in the specification and claims such as vertical, horizontal, top, bottom, upper and lower are to be interpreted as relational and are based on the premise that the component, item, article, apparatus, device or instrument will usually be considered in a particular orientation, which will usually be apparent from the context.

In the present specification, the term "integral" means formed of one body in a single process. In particular, the term "integrally formed" means formed of the one body without post-forming attachment of separately formed component parts. That is, "integrally formed" and the similar term "unitarily formed" mean formed in a single forming process and do not include post-forming attachment of component parts by means of fastener or other component fixing substances or methods.

The articles "a" and "an" are used herein to refer to one or to more than one (i.e. to at least one) of the grammatical object of the article. By way of example, "an element" means one element or more than one element.

It will be appreciated by those skilled in the art that many modifications and variations may be made to the methods of the invention described herein without departing from the spirit and scope of the invention. The features and components of each of the embodiments of the invention described in the detailed description and/or depicted in the accompanying drawings may be interchangeable as required, with regard to functional equivalency and compatibility. A feature or component described with reference to one but not all embodiments, if functionally and dimensionally compatible as an addition with another embodiment herein described, or substitutable with a corresponding feature or component of that other embodiment in relation to which it has not been expressly described, should be read as a potential addition or substitution to that other embodiment and as being within the scope of the invention. Furthermore, in considering a feature or component that is described in relation a particular embodiment but may be omitted from the embodiment without losing the functionality characterising the invention and without departing from the scope of the invention, unless the context and expressions used in describing the embodiment imputes that the feature or component is essential to the invention as broadly described, the omittable feature or component may be read as not being included in the embodiment.

The invention can be described in terms of provisional claims that can assist the skilled reader in understanding the various aspects and preferments of the invention. However, these provisional claims are not to be construed as defining statements of the invention. It will be appreciated that other forms, aspects and preferred features of the invention and its embodiments described herein may ultimately be included in the claims defining the invention in the specifications of complete, international or national applications (or their subsequent corresponding patent grants) that may claim priority from the provisional application accompanying this specification. In this context, the following non-limiting claims assist to better describe the invention:

I claim:

1. A jig for wooden beam construction, the jig adapted to hold in position an upper beam above a lower beam, the upper beam in or overlapping the lower beams vertical footprint, the jig including a fastener dispenser mounted on a translocatable carriage, the fastener dispenser adapted to mechanically attach the upper beam and the lower beam, wherein the jig includes at least one upper dispenser unit and at least one lower dispenser unit, the upper and lower dispenser units each including a fastener dispenser, the upper dispenser unit being adapted to be mounted above the wooden beam and the lower dispenser unit being adapted to be mounted below the wooden beam, each of the upper and lower fastener dispenser units being adapted to eject a fastener at a non-perpendicular angle to the respective longitudinal axes through the respective upper and lower beams into one of the mid supports to mechanically attach the upper beam and the lower beam.

2. The jig for wooden beam construction as claimed in claim 1, wherein the upper beam is adapted to be attached indirectly to the lower beam with an arrangement of mid supports bridging the upper and lower beams, the mid support in the form of wooden blocks or boards.

3. The jig for wooden beam construction as claimed in claim 1, wherein the fastener dispenser includes a pair of dispenser units orientated so that the fasteners are ejected at a non-perpendicular angle to a longitudinal axis of the upper and lower beams.

4. The jig for wooden beam construction as claimed in claim 1, wherein a method for construction of the wooden beam includes applying adhesive to the upper and lower wooden beams and clamping them together with the mid supports interposed between the upper and lower beams in the jig, locating the translocatable carriage at various points along the wooden beam in line with the mid supports and inserting fasteners through the upper and lower beams into the mid supports with the fastener dispenser to mechanically secure the wooden beam together.

5. The jig for wooden beam construction as claimed in claim 1, wherein the translocatable carriage is adapted to translocate along the jig on an upper and lower rail.

6. The jig for wooden beam construction as claimed in claim 1, wherein operation of the translocatable carriage and fastener dispenser is partially or fully automated.

7. The jig for wooden beam construction as claimed in claim 1, wherein the translocatable carriage includes a roller adapted to roll across an upper surface of the upper beam.

8. The jig for wooden beam construction as claimed in claim 7, wherein the roller is adapted to be located adjacent the dispenser units.

9. The jig for wooden beam construction as claimed in claim 4, wherein, the adhesive is applied to only near-upward or downward facing surfaces, being between zero and 15 degrees from vertically facing.

* * * * *